US011370020B2

(12) United States Patent
Spitans et al.

(10) Patent No.: US 11,370,020 B2
(45) Date of Patent: Jun. 28, 2022

(54) LEVITATION MELTING PROCESS

(71) Applicant: ALD VACUUM TECHNOLOGIES GMBH, Hanau (DE)

(72) Inventors: Sergejs Spitans, Hanau (DE); Henrik Franz, Freigericht-Horbach (DE); Bjoern Sehring, Bessenbach (DE); Markus Holz, Bruchkoebel (DE)

(73) Assignee: ALD Vacuum Technologies GMBH, Hanau (DE)

( * ) Notice: Subject to any disclaimer, the term of this patent is extended or adjusted under 35 U.S.C. 154(b) by 0 days.

(21) Appl. No.: 17/048,842

(22) PCT Filed: Apr. 18, 2019

(86) PCT No.: PCT/EP2019/060168
§ 371 (c)(1),
(2) Date: Oct. 19, 2020

(87) PCT Pub. No.: WO2019/202111
PCT Pub. Date: Oct. 24, 2019

(65) Prior Publication Data

US 2021/0146431 A1 May 20, 2021

(30) Foreign Application Priority Data

Apr. 20, 2018 (DE) ..... 10 2018 109 592.9

(51) Int. Cl.
*H05B 6/10* (2006.01)
*H05B 6/32* (2006.01)
(Continued)

(52) U.S. Cl.
CPC ..... *B22D 27/02* (2013.01); *B22D 39/003* (2013.01); *H05B 6/10* (2013.01); *H05B 6/32* (2013.01)

(58) Field of Classification Search
CPC ..... B22D 21/005; B22D 39/003
See application file for complete search history.

(56) References Cited

U.S. PATENT DOCUMENTS 1,399,769 A * 12/1921 Hodgkinson ..... B23K 35/0227 428/572
2,686,864 A 8/1954 Wroughton et al.
(Continued)

FOREIGN PATENT DOCUMENTS

CN 103862046 A 6/2014
DE 422004 C 11/1925
(Continued)

OTHER PUBLICATIONS

English language translation of International Search Report dated Sep. 16, 2019, prepared in International Application No. PCT/EP2019/060168.

(Continued)

*Primary Examiner* — Kevin E Yoon
*Assistant Examiner* — Jacky Yuen
(74) *Attorney, Agent, or Firm* — Barnes & Thornburg LLP; Ryan L. Marshall

(57) ABSTRACT

The invention relates to a method for producing casting bodies in a levitation melting method in which a batch of an electrically conductive material is brought into the sphere of influence of at least one alternating electromagnetic field by means of a starting material having a plurality of pre-separated batches separated by regions of reduced cross-section so that the batch is kept in a state of levitation. The regions are designed in such a way that separation of the pre-separated batches takes place only during melting in an alternating electromagnetic field. The melt is then cast into casting moulds.

16 Claims, 2 Drawing Sheets

(51) Int. Cl.
*B22D 39/00* (2006.01)
*B22D 27/02* (2006.01)

(56) References Cited

U.S. PATENT DOCUMENTS

| | | | | |
|---|---|---|---|---|
| 3,435,878 | A * | 4/1969 | Howard et al. ..... | B22D 18/04 164/493 |
| 4,578,552 | A | 3/1986 | Mortimer | |
| 5,738,163 | A | 4/1998 | Demukai et al. | |
| 5,837,055 | A | 11/1998 | Yamada et al. | |
| 2019/0366427 | A1 | 12/2019 | Franz et al. | |

FOREIGN PATENT DOCUMENTS

| | | | |
|---|---|---|---|
| DE | 69617103 | | 1/2002 |
| DE | 102017100836 | A1 | 8/2018 |
| EP | 0 988 959 | A2 | 3/2000 |
| EP | 0747648 | B1 | 11/2001 |
| EP | 0935006 | B1 | 7/2003 |
| JP | 06142895 | A | 5/1994 |
| JP | 3992376 | B2 | 10/2007 |
| WO | 2009064731 | A2 | 5/2009 |

OTHER PUBLICATIONS

English language translation of International Preliminary Reporton Patentability dated Sep. 16, 2019, prepared in International Application No. PCT/EP2019/060168.
English language translation of Korean Office Action dated Oct. 27, 2020, in Korean Application No. 10-2020-7025504.

* cited by examiner

LEVITATION MELTING PROCESS

This application is a National Stage application of International Application No. PCT/EP2019/060168, filed Apr. 18, 2019. This application also claims priority under 35 U.S.C. § 119 to German Patent Application No. 10 2018 109 592.9, filed Apr. 20, 2018.

This invention concerns a levitation melting method for the production of casting bodies with a starting material for several batches. The method uses a starting material comprising several individual batches separated by regions of reduced cross section. By feeding the batches via a single ingot, a more efficient melting of the batches can be achieved in addition to a more favourable production of the batch materials. During the melting process, the melt does not come into contact with the material of a crucible, so that contamination by the crucible material or by the reaction of the melt with crucible material is avoided.

The avoidance of such impurities is particularly important for metals and alloys with high melting points. Such metals include titanium, zirconium, vanadium, tantalum, tungsten, hafnium, niobium, rhenium and molybdenum. However, this is also important for other metals and alloys such as nickel, iron and aluminium.

STATE OF THE ART

State-of-the-art levitation melting methods are known. DE 422 004 A already reveals a melting method in which the conductive material to be melted is heated by inductive currents and at the same time kept levitating by electrodynamic action. There is also described a casting method in which the molten material is pressed into a mould by a magnet (electrodynamic pressure casting). The method can be carried out in a vacuum.

U.S. Pat. No. 2,686,864 A also describes a method in which a conductive melt is put into a state of levitation, e.g. in a vacuum under the influence of one or more coils without the use of a crucible. In one design, two coaxial coils are used to stabilize the material in levitation. After melting, the material is dropped or cast into a mould. With the method described there, an aluminium portion weighing 60 g could be held in levitation. The molten metal is removed by reducing the field strength so that the melt escapes downwards through the tapered coil. If the field strength is reduced very quickly, the metal falls out of the device in the molten state. It has already been recognized that the "weak spot" of such coil arrangements is in the centre of the coils, so the amount of material that can be melted is limited.

U.S. Pat. No. 4,578,552 A also reveals a device and method for levitation melting. The same coil is used for both heating and holding the melt, wherein the frequency of the alternating current applied is varied to control the heating power while keeping the current constant.

The particular advantage of levitation melting is that it avoids contamination of the melt by a crucible material or other materials in contact with the melt during other methods. The levitating melt is only in contact with the surrounding atmosphere, which can be vacuum or inert gas, for example. Since there is no need to fear a chemical reaction with a crucible material, the melt can be heated to very high temperatures. In addition, the scrap of contaminated material is reduced, especially in comparison to the melt in the cold crucible. However, levitation melting has not become established in practice. The reason for this is that only a relatively small amount of molten material can be held in levitation during the levitation melting method (cf. DE 696 17 103 T2, page 2, paragraph 1).

In all levitation melting methods, the batches of starting material are introduced into the induction coil region in the form of individual ingots. This is usually done by means of a gripper which picks up the ingots at a feed position, moves them in the induction coil region and then releases them after switching on the magnetic field. This often involves problems with the stability of the ingots in the magnetic field and splashing during melting. The production of these relatively small ingots is comparatively complex and expensive.

Another disadvantage with regard to the maximum efficiency that can be achieved when using the induced eddy currents to heat the ingots is owed to the principle involved. The Lorentz force of the coil field must compensate for the weight force of the batch in order to keep it in levitation. It pushes the batch upwards out of the coil field. As a result, the batch does not sink as deeply into the magnetic field as would be necessary for optimal utilization of the magnetic field for heating the batch. Rather, it levitates above this optimal level.

Finally, the time required to feed individual ingots is a limiting factor in the achievable cycle times.

The disadvantages of state-of-the-art methods can be summarized as follows. Full levitation melting methods can only be carried out with small quantities of material, so that an industrial application has not yet taken place. Furthermore, the casting in moulds is difficult. The levitation principle limits the magnetic field that can be used to heat the batch and its efficiency in generating eddy currents. Problems with the stability of the ingots in the magnetic field and spattering during melting can occur. The production of the ingots is comparatively complex and expensive.

Task

It is therefore a task of the present invention to provide a method that enables the economic use of levitation melting. In particular, the method should enable a high throughput by improving the efficiency of the melting process and permit the use of cost-effective ingots for the batches.

DESCRIPTION OF THE INVENTION

The task is solved by the method according to the invention. Furthermore, the task is also solved by the use of a source material according to the invention in a levitation melting method. According to the invention, a method for the production of casting bodies from an electrically conductive material comprises the following steps:

- introducing of the lowest batch of a starting material for several batches into the sphere of influence of at least one electromagnetic alternating field (melting section), wherein the starting material is of an electrically conductive material having several pre-separated batches separated by regions of reduced cross-section and the regions are designed in such a way that a separation of the pre-separated batches takes place only during melting in an electromagnetic alternating field,
- melting the batch,
- lifting the remaining unmelted starting material from the molten batch in a levitating state,
- overheating the levitating batch,
- positioning a mould in a filling area below the levitating batch,
- casting the entire batch into the mould,
- removal the solidified casting body from the mould.

The volume of the molten batch is preferably sufficient to fill the mould to a level sufficient for the production of a casting ("filling volume"). After filling the mould, it is left to cool or cooled with coolant so that the material solidifies in the mould. The casting body can then be removed from the mould. The casting can consist of dropping the batch, in particular by switching off the alternating electromagnetic field; or the casting can be slowed down by an alternating electromagnetic field, e.g. by using a coil.

A "conductive material" is understood to be a material which has a suitable conductivity for inductively heating the material and holding it in levitation.

A "levitating state" is defined as a state of complete levitation so that the treated batch has no contact whatsoever with a crucible or platform or the like.

A "cylindrical" ingot is understood in the context of this application as an ingot in the form of the mathematic definition of a general cylinder, in particular a general straight cylinder, wherein the definition explicitly includes the special shapes of the prism, in particular the straight prism, and the cuboid. Preferably it is a straight circular cylinder or a straight prism with hexagonal to icositetragonal base areas.

The "lowest" batch is defined according to the invention as the batch of a starting material according to the invention located at the end of the starting material distal to the end by which the starting material is held and moved.

The feeding of batches via a source material that combines several batches instead of individual batches offers several advantages. By arranging the batches in the manner of an essentially rod-shaped structure, firstly they can be introduced deeper into the magnetic field of the coils. In contrast to a single batch, the starting material does not need to levitate, but is held mechanically in position. The remaining starting material can press the lowest batch to be melted into the magnetic field. This increases the melting efficiency of the batch. Only when the batch begins to melt do the molten components enter the levitating state. The holding force of the remaining starting material also ensures that the batch is stabilized in the magnetic field. When the batch has melted, the remaining starting material is pulled upwards and the free-levitating melt is superheated.

Most preferably, the batch is introduced into the alternating electromagnetic field to such an extent that the induced eddy current is at its maximum. In this way, the batch can be heated optimally, which leads to an acceleration of the entire casting process.

In a highly preferred version of the method according to the invention, the starting material for several batches consists of a cylindrical rod, that has along its longitudinal axis regions having a reduced cross-section, wherein the individual regions having the non-reduced cross-section each correspond to the amount of material of a batch. In principle, the effect of stabilization and improved utilization of the generated magnetic field is achieved in accordance with the invention for any form of batch. However, bars in the form of a circular cylinder or a prism with an approximately circular base area can be produced particularly easily and inexpensively, for example in continuous casting. Then all that remains to be done is to turn, saw or cut the regions separating the batches into the raw rod.

It is not necessary for any design form of the starting material to have the same batch size. As a rule, the same size batches are required for series production of similar parts. However, it is also possible to use moulds with several cavities that require different filling quantities. The present invention therefore comprises raw materials with different batches adapted to these requirements.

The regions with a reduced cross-section that separate the individual batches ensure on the one hand a lower heat conduction and on the other hand a restriction of the induced eddy currents to the batch to be melted in the magnetic field.

Preferably, therefore, in the starting material for several batches, the cross-section between the batches is reduced to such an extent and/or the regions with a reduced cross-section are so long that the eddy current induced in an electromagnetic alternating field in a batch is limited to such an extent that the adjacent batch is not melted with it. This must be taken into account when designing the regions connecting the batches in order to achieve an optimal ratio between space-saving arrangement and the risk of melting of the adjacent batch.

Similarly, preferably in the case of the starting material for several batches, the heat conduction of the regions having the reduced cross-section is so low that when one batch is melted the adjacent batch is not melted with it.

For the method according to the invention, it is highly preferable for the starting material for several batches to have the regions with the reduced cross-section dimensioned at least in such a way that they have a mechanical load-bearing capacity, which is sufficient for the respective weight of the starting material to be carried. Since the starting materials are used in a hanging arrangement, it is advantageous if the regions connecting the batches, which have the lowest mechanical strength due to the reduced cross-section, are able to support the entire region below each of them. This eliminates the need for a feeding mechanism to stabilize the starting material. If the minimum possible cross-sections are used, they decrease from top to bottom. It is not necessary to design all cross-sections in the same way, i.e. to use the connection of the uppermost batch as a reference.

In a preferred embodiment, the electrically conductive material used in accordance with the invention has at least one high-melting metal from the following group: titanium, zirconium, vanadium, tantalum, tungsten, hafnium, niobium, rhenium, molybdenum. Alternatively, a less high-melting metal such as nickel, iron or aluminium can be used. A mixture or alloy with one or more of the above metals can also be used as a conductive material. Preferably, the metal has a proportion of at least 50% by weight, in particular at least 60% by weight or at least 70% by weight, of the conductive material. It has been shown that these metals particularly benefit from the advantages of the present invention. In a particularly preferred embodiment, the conductive material is titanium or a titanium alloy, in particular TiAl or TiAlV. These metals or alloys can be processed in a particularly advantageous way because they have a pronounced dependence of viscosity on temperature and are also particularly reactive, particularly with regard to the materials of the mould. Since the method according to the invention combines contactless melting in a levitating state with extremely fast filling of the mould, a particular advantage can be realized for such metals. The invention-based method can be used to produce casting bodies that exhibit a particularly thin oxide layer or even no oxide at all from the reaction of the melt with the material of the casting mould. And especially in the case of high-melting metals, the improved utilization of the induced eddy current and the associated faster heating is noticeable in the cycle times.

An advantageous embodiment of the method uses the electrically conductive material in powder form. If, for example, the batches are to be designed in spherical form, a great deal of material would have to be removed from a solid metal rod during turning. A structure consisting of individual balls screwed together with rods would cause considerable additional work during manufacture and assembly. However, if powder is used, the form can be produced more easily. This is most preferably done by pressing with a binding agent and/or sintering. Possible binders include paraffins, waxes or polymers, each of which allows a low working temperature.

In an advantageous embodiment of the invention, the conductive material is overheated during melting to a temperature, which is at least 10° C., at least 20° C. or at least 30° C. above the melting point of the material. The overheating prevents the material from solidifying instantly on contact with the mould, the temperature of which is below the melting point. It is achieved that the batch can be distributed in the mould before the viscosity of the material becomes too high. One advantage of levitating melting is that there is no need to use a crucible that is in contact with the melt. This avoids the high material loss of the cold crucible method as well as contamination of the melt by crucible components. A further advantage is that the melt can be heated to a relatively high temperature, since operation in a vacuum or under protective gas is possible and there is no contact with reactive materials. Nevertheless, most materials cannot be overheated at will, as otherwise, a violent reaction with the mould is to be feared. Therefore, the overheating is preferably limited to a maximum of 300° C., especially 200° C. and preferably 100° C. above the melting point of the conductive material.

In an advantageous version of the method, at least one ferromagnetic element is arranged horizontally around the region in which the batch is melted in order to concentrate the magnetic field and stabilize the batch. The ferromagnetic element can be arranged in a ring around the melting region, whereby "ring-shaped" means not only circular elements but also angular, in particular square or polygonal ring elements. The element can have several rod sections, which protrude in particular horizontally in the direction of the melting region. The ferromagnetic element consists of a ferromagnetic material, preferably with an amplitude permeability $\mu_a>10$, more preferably $\mu_a>50$ and particularly preferably $\mu_a>100$. Amplitude permeability refers in particular to permeability in a temperature range between 25° C. and 100° C. and at a magnetic flux density between 0 and 400 mT. The amplitude permeability is in particular at least one hundredth, in particular at least 10 hundredth or 25 hundredth, of the amplitude permeability of soft magnetic ferrite (e.g. 3C92). Suitable materials are known to the person skilled in the art.

Furthermore, according to the invention is the use of an electrically conductive material as starting material for a levitation melting method, in which the starting material has several pre-separated batches separated by regions with a reduced cross-section, wherein a separation of the pre-separated batches takes place only during melting in an electromagnetic alternating field.

FIGURE DESCRIPTION

The figures show preferred embodiments. They are for illustration purposes only.

Figure 1:
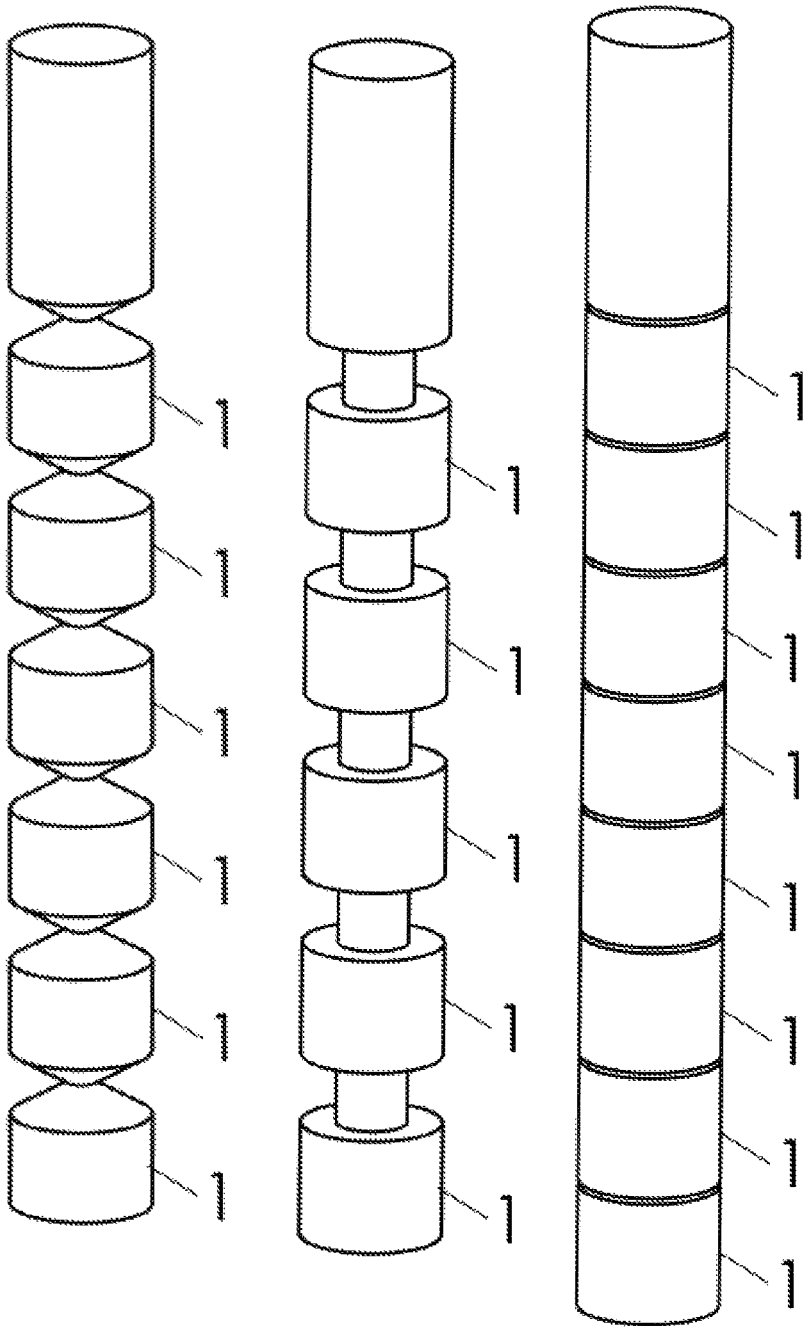
FIG. 1 is a side view of three embodiments of a starting material according to the invention.

FIG. 1 shows a side view of three embodiments of a starting material according to the invention made of electrically conductive material. All three are vertical circular cylindrical forms. At the upper end, there is a region suitable for mounting in a feeding device. Depending on the method of attachment, this area may be smooth, as shown in the illustration, or provided with holes or a three-dimensional surface structure, in particular an end circumferential widening which allows it to be gripped by a hook or gripper.

The left starting material has six batches, the middle five batches and the right eight batches (1). In the case of the left starting material, the individual batches (1) are separated by notches in a triangular shape. These notches can, for example, be produced by a punch without loss of material. In the middle starting material, the individual batches (1) are separated by wider regions with a reduced cross-section. Such a design can be produced in a simple and cost-effective way by turning a cylindrical rod. The starting material on the right, respectively, has narrow circumferential incisions for the separation of the individual batches (1). In principle, the structure is the same as with the middle starting material, only the distances are reduced and the cross-section of the regions having a reduced cross-section is further reduced. Due to the further reduced cross-section, a better limitation of the induced eddy currents and lower heat conduction can be achieved in order to compensate for the shorter distance.

Figure 2:
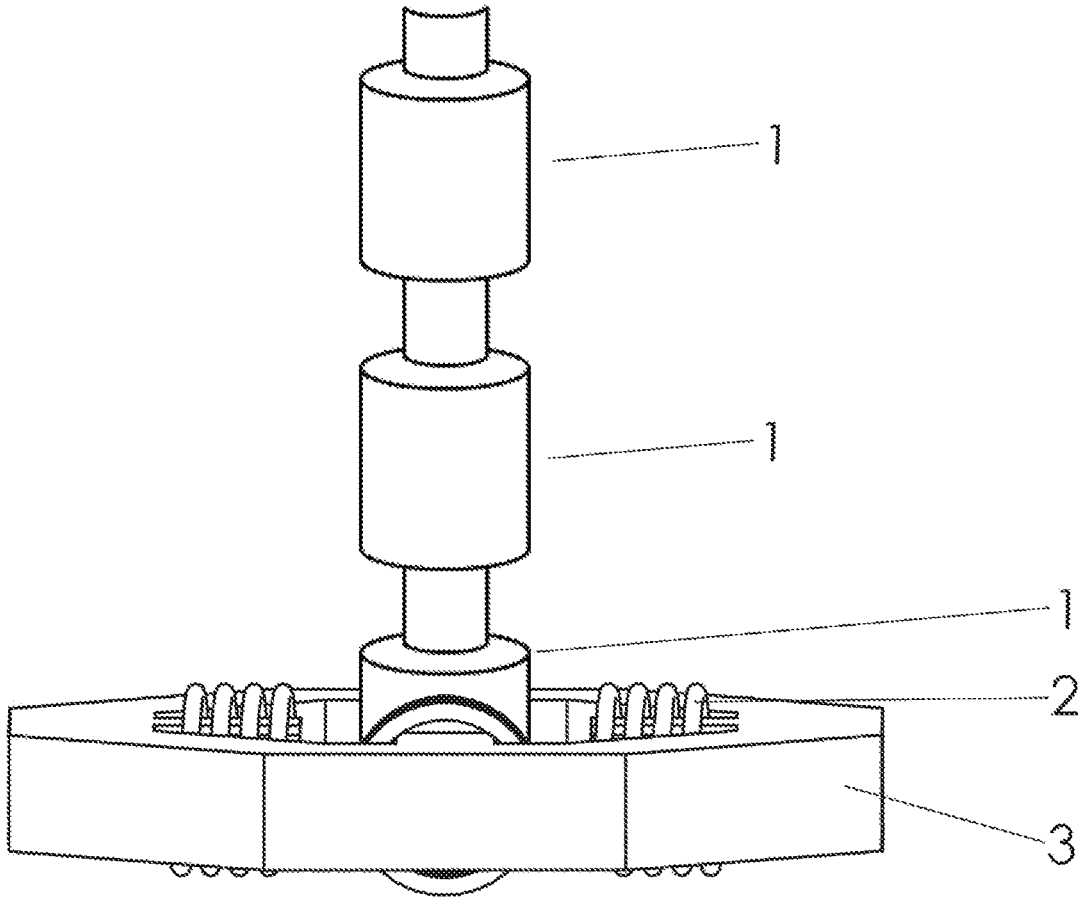
FIG. 2 is a side view of the structure of a melting region with ferromagnetic element, coils and the lower partial portion of a starting material for several batches.

FIG. 2 shows the section of the lowest three batches (1) of the middle starting material from FIG. 1. The lowest batch (1) is in the sphere of influence of alternating electromagnetic fields (melting region) generated by the coils (2). Below the batch (1) there is an empty casting mould which is held in the filling area by a holder (not shown). A ferromagnetic element (3) is arranged around the sphere of influence of the coils (2). The batch (1) is melted and levitated in the method according to the invention. After the batch (1) has melted, the remaining starting material is drawn upwards and the melt is superheated. The melt is then cast into the casting mould and the solidified casting body is finally removed from the casting mould.

LIST OF REFERENCE SIGNS

1 batch
2 coil
3 ferromagnetic element

The invention claimed is:

1. A method for producing casting bodies from an electrically conductive material by levitation melting, comprising:

introducing of a lowest batch of a starting material for several batches into a sphere of influence of at least one electromagnetic alternating field, wherein the electromagnetic alternating field is created by means of horizontally arranged coils, and wherein the starting material is of an electrically conductive material having several pre-separated batches separated by regions of reduced cross-section and the regions are designed in such a way that separation of the pre-separated batches takes place only during melting in an electromagnetic alternating field, melting the lowest batch, wherein the batch has no contact with a crucible or platform, and wherein the remaining starting material pushes the lowest batch to be melted so far into the alternating electromagnetic field that an induced eddy current is at its maximum, lifting the remaining unmelted starting material from the molten lowest batch in a levitating state, overheating the levitating lowest batch, positioning a mold in a filling area below the levitating lowest batch, casting the entire lowest batch into the mold, removal of a solidified casting body from the mold.

2. The method according to claim 1, wherein the starting material for several batches consists of a cylindrical rod that along its longitudinal axis has regions having reduced cross-sections, wherein the individual regions having the non-reduced cross-section each correspond to the amount of material of a batch.

3. The method according to claim 1, wherein in the starting material for several batches, the cross-section between the batches is reduced to such an extent and/or the regions with reduced cross-section are so long that an eddy current induced in an electromagnetic alternating field in a batch is delimited to such an extent that an adjacent batch is not melted with it.

4. The method according to claim 1, wherein in the starting material for several batches, the regions having a reduced cross-section are dimensioned at least in such a way that they have a mechanical load-bearing capacity that is sufficient for the respective weight of the starting material to be carried.

5. The method according to claim 1, wherein in the starting material for several batches, a heat conduction of the regions having a reduced cross-section is so low that, when a batch is melted, an adjacent batch is not melted with it.

6. The method according to claim 1, wherein the electrically conductive material contains at least one metal from the following group: titanium, zirconium, vanadium, tantalum, tungsten, hafnium, niobium, rhenium, molybdenum, nickel, iron, aluminum.

7. The method according to claim 6, wherein the metal has a proportion of at least 50% by weight of the conductive material.

8. The method according to claim 6, wherein the metal has a proportion of at least 60% by weight of the conductive material.

9. The method according to claim 6, wherein the metal has a proportion of at least 70% by weight of the conductive material.

10. The method according to claim 1, wherein the electrically conductive material is titanium or a titanium alloy.

11. The method according to claim 1, wherein the electrically conductive material is TiAl or TiAlV.

12. The method according to claim 1, wherein the electrically conductive material is used in powder form.

13. The method according to claim 12, wherein the starting material for several batches is produced from the electrically conductive material by pressing with a binding agent and/or sintering.

14. The method according to claim 1, wherein the conductive material is superheated during melting to a temperature that is at least 10° C. above the melting point of the material.

15. The method according to claim 1, wherein the conductive material is superheated during melting to a temperature that is at least 20° C. above the melting point of the material.

16. The method according to claim 1, wherein the conductive material is superheated during melting to a temperature that is at least 30° C. above the melting point of the material.

* * * * *